US010217585B2

(12) United States Patent
Wang

(10) Patent No.: US 10,217,585 B2
(45) Date of Patent: Feb. 26, 2019

(54) CONTROL CIRCUIT FOR COMPOSITE SWITCH WITH CONTACT PROTECTION BASED ON DIODE AND RELAY CONTROL METHOD

(71) Applicant: Gyrk International Technology Co., Ltd., Beijing (CN)

(72) Inventor: Hai Wang, Beijing (CN)

(73) Assignee: Gyrk International Technology Co., Ltd., Beijing (CN)

( * ) Notice: Subject to any disclaimer, the term of this patent is extended or adjusted under 35 U.S.C. 154(b) by 387 days.

(21) Appl. No.: 14/901,186

(22) PCT Filed: Jun. 26, 2014

(86) PCT No.: PCT/CN2014/080785

§ 371 (c)(1),
(2) Date: Dec. 28, 2015

(87) PCT Pub. No.: WO2014/206306

PCT Pub. Date: Dec. 31, 2014

(65) Prior Publication Data

US 2016/0148768 A1 May 26, 2016

(30) Foreign Application Priority Data

Jun. 28, 2013 (CN) ..... 2013 1 0265141

(51) Int. Cl.
*H01H 9/00* (2006.01)
*H01H 47/00* (2006.01)
(Continued)

(52) U.S. Cl.
CPC ..... *H01H 47/22* (2013.01); *H01H 9/541* (2013.01); *H01H 47/02* (2013.01)

(58) Field of Classification Search
CPC ..... H01H 47/22; H01H 47/02
(Continued)

(56) References Cited

U.S. PATENT DOCUMENTS 3,293,496 A * 12/1966 Induni ..... H01H 9/541 361/6
4,462,057 A * 7/1984 Kobayashi ..... H01H 9/541 361/2
(Continued)

FOREIGN PATENT DOCUMENTS

CN 1377051 10/2002
CN 101635209 1/2010
(Continued)

OTHER PUBLICATIONS

International Search Report for priority PCT Application No. PCT/CN2014/080785 dated Sep. 19, 2014 (2 pages).
(Continued)

*Primary Examiner* — Thienvu Tran
*Assistant Examiner* — Lucy Thomas
(74) *Attorney, Agent, or Firm* — Barnes & Thornburg LLP; Jeffrey Stone

(57) ABSTRACT

A composite switch with diode contact protection based on a diode is disclosed and includes a primary relay contact protection circuit, a primary relay contact and a relay control circuit, where the primary relay contact protection circuit is formed by an auxiliary relay contact and a diode connected in series and is connected with the primary relay contact in parallel, a current capacity of the auxiliary relay contact is 1/10 to 1/1000 of a current capacity of the primary relay contact.

6 Claims, 5 Drawing Sheets

Figure 1:
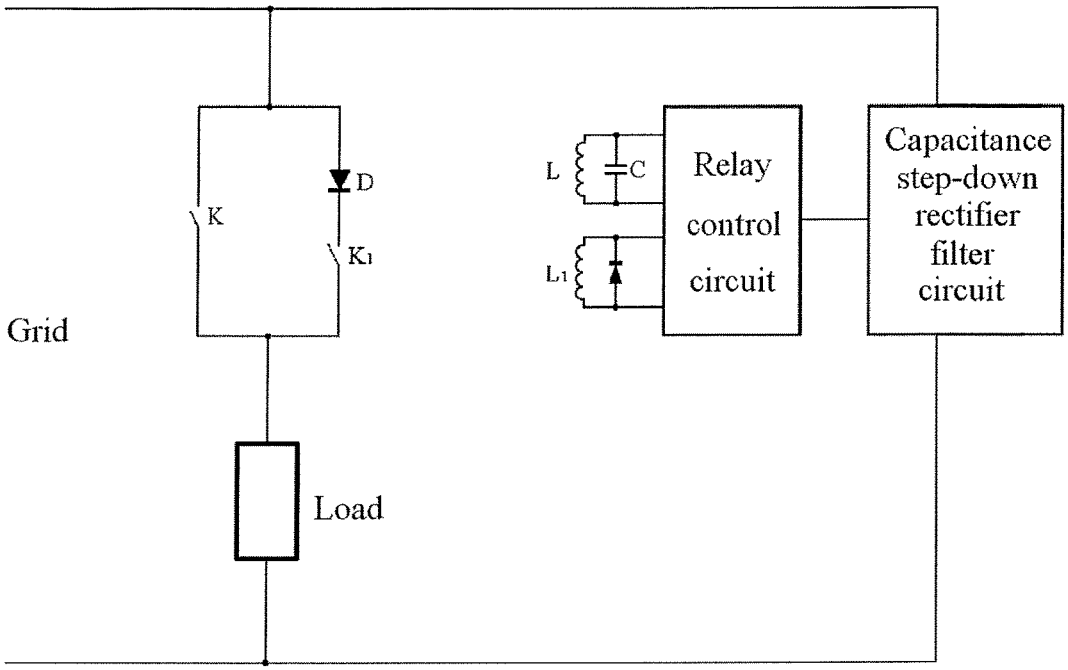

(51) Int. Cl.
*H01H 47/22* (2006.01)
*H01H 47/02* (2006.01)
*H01H 9/54* (2006.01)

(58) Field of Classification Search
USPC ..... 361/194
See application file for complete search history.

(56) References Cited

U.S. PATENT DOCUMENTS

| | | | | |
|---|---|---|---|---|
| 5,952,856 | A * | 9/1999 | Horiguchi | H03K 17/663 318/696 |
| 2011/0273812 | A1* | 11/2011 | Beer | F02D 41/20 361/152 |

FOREIGN PATENT DOCUMENTS

| | | |
|---|---|---|
| CN | 201860115 U | 6/2011 |
| CN | 102299519 | 12/2011 |
| CN | 102623220 | 8/2012 |
| JP | 121810 | 8/1984 |
| JP | 2000306472 | 11/2000 |
| JP | 2006059666 | 3/2006 |
| JP | 2010118251 | 5/2010 |
| JP | 2013090550 | 5/2013 |

OTHER PUBLICATIONS

European Search Report from related EP application No. 14817223.2, dated Jan. 3, 2017.

Database WPI, Section EI, Week 201209, Thomson Scientific, London, GB; Class U21, AN 2012-A71140, XP002765197, -& CN 102 299 519 A (Wang, Hai), Dec. 28, 2011 (Dec. 28, 2011) *abstract; figures 1, 4*.

Database WPI, Section EI, Week 201311, Dec. 15, 2011 (Dec. 15, 2011), Thomson Scientific, London, GB; Class V03, AN 2012-M93060, XP002765198, -& CN 102 623 220 A (Wang, Hai) Aug. 1, 2012 (Aug. 1, 2012) *abstract; figure 1*.

Database WPI, Week 200316, Thomson Scientific, London, GB; AN 2003-158121, XP002765199, -& CN 1 377 051 A (Wang Z) Oct. 30, 2002 (Jan. 30, 2002) *abstract; figures 1, 2*.

* cited by examiner

CONTROL CIRCUIT FOR COMPOSITE SWITCH WITH CONTACT PROTECTION BASED ON DIODE AND RELAY CONTROL METHOD

CROSS-REFERENCE TO RELATED APPLICATIONS

This application is a US national phase application of international patent application No. PCT/CN2014/080785 filed on Jun. 26, 2014, which claims priority to Chinese patent application No. 201310265141.1, entitled "Control Circuit For Composite Switch With Contact Protection Based on Diode and Relay Control Method" and filed on Jun. 28, 2013, the disclosure of which is incorporated therein by reference in its entirety.

TECHNICAL FIELD

This invention relates to an alternating current (AC) relay switch, especially to a relay switch in which a diode and a mechanical contact switch are connected in series to prevent electric arcs generated at a contact of an AC switch when the AC switch is closed or opened, as well as a relay drive circuit and a relay control method, which are classified to international classification Nos. H01H9154 and H01H9/56.

BACKGROUND

An ideal AC relay switch completes connection or disconnection of its contact at the moment of a zero-crossing point of current. However, due to the time for the movement process of a mechanical contact, a mechanical contact switch cannot be closed or opened at the zero-crossing point theoretically; especially under circumstances of high voltages and high currents, severe sparking and arc discharge phenomenon occur particularly when inductive and capacitive loads are switched on and off, leading to a shortened service life of the switch contact and a potential surge current or voltage harmful to the power grid. Considering that it is impossible for AC relay switches to close or open at the zero-crossing point of current, engineers have attempted to find a way of eliminating the arc discharge at the switch contact from the time when the AC switches were put into use. The emergency of a Silicon Controlled Rectifier (SCR) enables an electronic AC switch which may be closed or opened at a zero-crossing point of current. Nevertheless, due to power consumption and cost problems, the AC switch adopting the SCR cannot be practical and reliable. Meanwhile, numerous researches have performed researches on a low-power-consumption and low-cost composite switch in which an SCR and a relay contact are connected in parallel. However, the SCR is defective for a possible erroneous turning on in the case of high dv/dt and a difficulty in turning off in the case of high di/dt, the SCR composite switch has not been applied practically.

U.S. Pat. Nos. 3,223,888 and 3,284,684 and a Chinese patent application No. 01111050.3 disclose a way of protecting a main relay contact by using a diode, that is, a switch with a mechanical breakpoint upon opening of the switch, where a diode ensures that a contact of the primary switch is applied with merely a forward voltage of the diode at the moment when the contact of the primary switch is connected or disconnected. However, the circuits disclosed in these patents have strict requirements for contact travel time (i.e. duration from the time when the actuation of the contact begins to the time when the actuation of the contact fully stops) of both the secondary relay and the primary relay. For resistive and inductive loads, the switch contact should be connected or disconnected within ½ of an AC cycle; for a capacitive load, it is required that the travel time of the relay contact is less than ¼ of the AC cycle. That is, in the case of 50 Hz AC current, the travel time of the contact is less than 10 mS for the resistive and inductive loads and is less than 5 mS for the capacitive load. In the case of 60 Hz AC current, the desired travel time of the contact is even shorter, and cannot be achieved by general switch relay contacts. Moreover, with the increase of use time of the relay, the contact travel time varies and is prolonged. The existing relays cannot meet the requirements for the switch contact protection by the serial connection between a diode and an auxiliary relay contact as disclosed in the above patents. Therefore, the above patents do not mention which relays are applicable to fulfill the contact protection function, which is also the reason why the circuit of the switch with contact protection based on a diode has not been applied after being proposed more than half a century ago.

With regard to an AC switch relay, jitter sparking takes places at a contact of the AC switch relay when the contact is connected, and arc discharging takes place when the contact is disconnected, while the arc extinguishes at the zero-crossing point of the AC current. The speed of the actuation of the contact is required to ensure that the arc will not be reignited after extinguishing, thus the travel time of the contact of the AC switch relay is required to be short enough. Because jitter happens to the relay contact when the relay contact is connected, damping is generally enhanced in the mechanical system of the relay in order to decrease the number of jitters of the contact. For the purpose of shortening the travel time of the relay contact, a drive current of a relay coil is increased or the damping of the mechanical system is decreased; but the increase of the drive current of the relay coil or the decrease of the damping of the mechanical system makes the jitter upon the connection of the contact more severe, thereby degrading performances of connecting the contact and shortening the mechanical service life of the relay. Thus, it is rather difficult for the AC switch relay to improve its contact actuation speed on the premise that its mechanical service life is guaranteed.

SUMMARY OF THE INVENTION

Technical Problem to be Solved

The invention aims to provide a way of implementing a composite switch with contact protection based on a contact, especially a control circuit and a control method for improving the actuation speed of a relay contact and reducing travel time of the relay contact, which can shorten the travel time of the relay contact by more than 2 times. Especially, a control circuit and a control method for a magnetic latching relay are provided.

Technical Solutions

The aim of the invention is realized by the following scheme: a composite switch with contact protection based on a diode, comprising a primary relay contact protection circuit, a primary relay contact and a relay control circuit, wherein the primary relay contact protection circuit, which is constituted by an auxiliary relay contact K1 and a diode D connected in series, is connected with the primary relay contact K in parallel, a current capacity of the auxiliary relay contact K1 is 1/10 to 1/1000 of that of the primary relay contact K, and when a primary relay is closed or opened, a current flowing through a relay coil varies according to a predefined rule to shorten contact travel time.

Furthermore, in the composite switch with contact protection based on a diode, the relay control circuit is powered by a capacitance step-down rectifier power supply.

Furthermore, in the composite switch with contact protection based on a diode, a plurality of auxiliary relay contacts are connected in series to resolve the problem of an insufficient withstand voltage of a single relay contact, and a plurality of primary relay contacts are connected in parallel to resolve the problem of an insufficient current capacity of a single relay contact.

Furthermore, the relay control circuit is formed by a singlechip, an auxiliary relay drive circuit and a primary relay drive circuit, a drive coil L for the primary relay is connected in parallel with a capacitor C and is connected between output terminals 1 and 2 of an H-bridge constituted by four transistors T3, T4, T5 and T6; wherein two output terminals 3 and 4 of the singlechip are configured to control a width and a polarity of an output voltage pulse from the H-bridge by means of an inverter constituted by transistors T1 and T2; during an actuation of the primary relay contact, a voltage provided by the relay control circuit to the drive coil L for the primary relay is a PWM pulse signal, and a current flowing through the drive coil L is changing.

In the composite switch with contact protection based on a diode, a drive coil L1 for an auxiliary relay is connected to a capacitor C6 via a transistor T11, and when the auxiliary relay contact is actuated, the transistor T11 is turned on under the control of the singlechip, the capacitor C6 discharges to the drive coil through the transistor T11, a current flowing through the drive coil L1 decreases in a logarithmic manner, and when the actuation of the relay contact stops, the singlechip is configured to turn off the transistor T11 and turn on a transistor T10 to charge the capacitor C6.

In the composite switch with contact protection based on a diode, the auxiliary relay and the primary relay are magnetic latching relays.

In the composite switch with contact protection based on a diode, the relay control circuit includes a current measuring circuit and a voltage measuring circuit.

The relay control methods includes: Step 1) to close the relay, the relay control circuit provides a changing current, which has an initial value that is 2-20 times greater than a rated operational current, to the drive coil for the relay, so that a movable contact of the relay is rapidly moved to a stationary contact, subsequently the current flowing through the drive coil for the relay is decreased constantly until zero, and the current to the drive coil is maintained at the level of a closure holding current of the relay after the movable contact contacts the stationary contact; and Step 2) to open the relay, the relay control circuit provides a changing current, which has an initial value that is 2-20 times greater than the rated operational current, to the drive coil for the relay, so that the movable contact of the relay is rapidly moved apart from the stationary contact, subsequently the current flowing through the drive coil for the relay is decreased constantly, and the current to the drive coil become zero after the movable contact arrives at its normally open position.

Beneficial Effects

The present invention is beneficial in that: the actuation speed of the relay contact is improved and a stress received by the contact when the actuation of the relay contact stops is reduced, so as to reduce jitters of the contact, shorten the time for the actuation of the relay contact, and significantly prolong the mechanical service life of the relay. In addition, with the control circuit and the control methods for the relay provided by this invention, it is guaranteed that the contacts of both the auxiliary relay and the primary relay can be connected within ¼ of one AC cycle as required by the diode-based contact protection circuit, so that the switch can be closed or opened at the time of a zero-crossing point of current, thereby actually achieving electrical arc extinguishing of an AC switch to substantially prolong the electrical service life of the switch.

BRIEF DESCRIPTION OF THE ACCOMPANYING DRAWINGS

Figure 2:
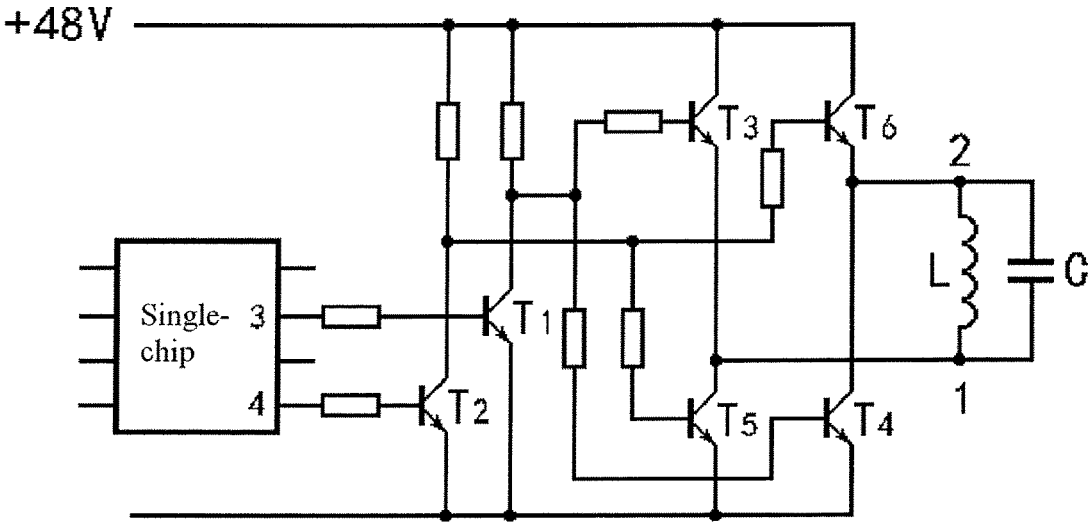
Figures 1, 3:
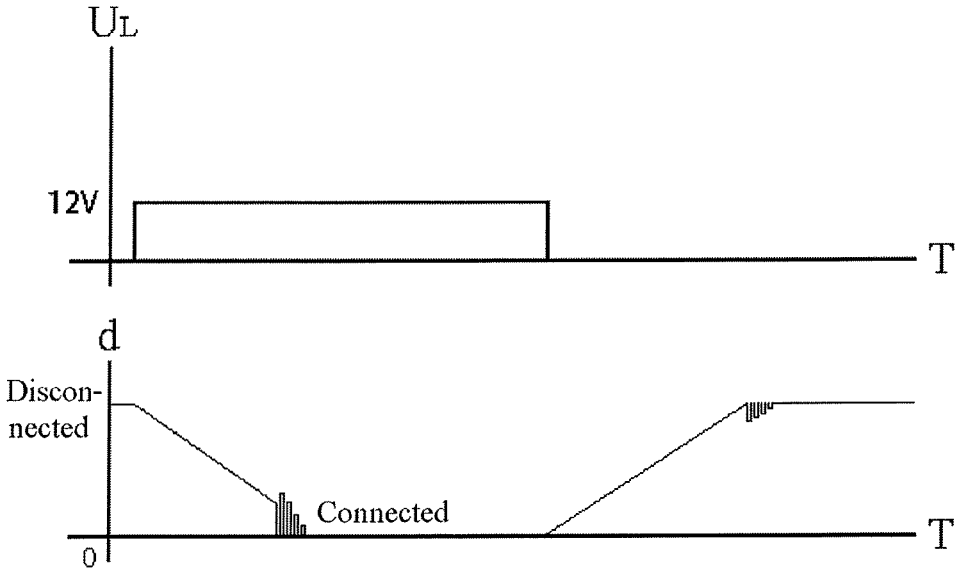
Figures 2, 3:
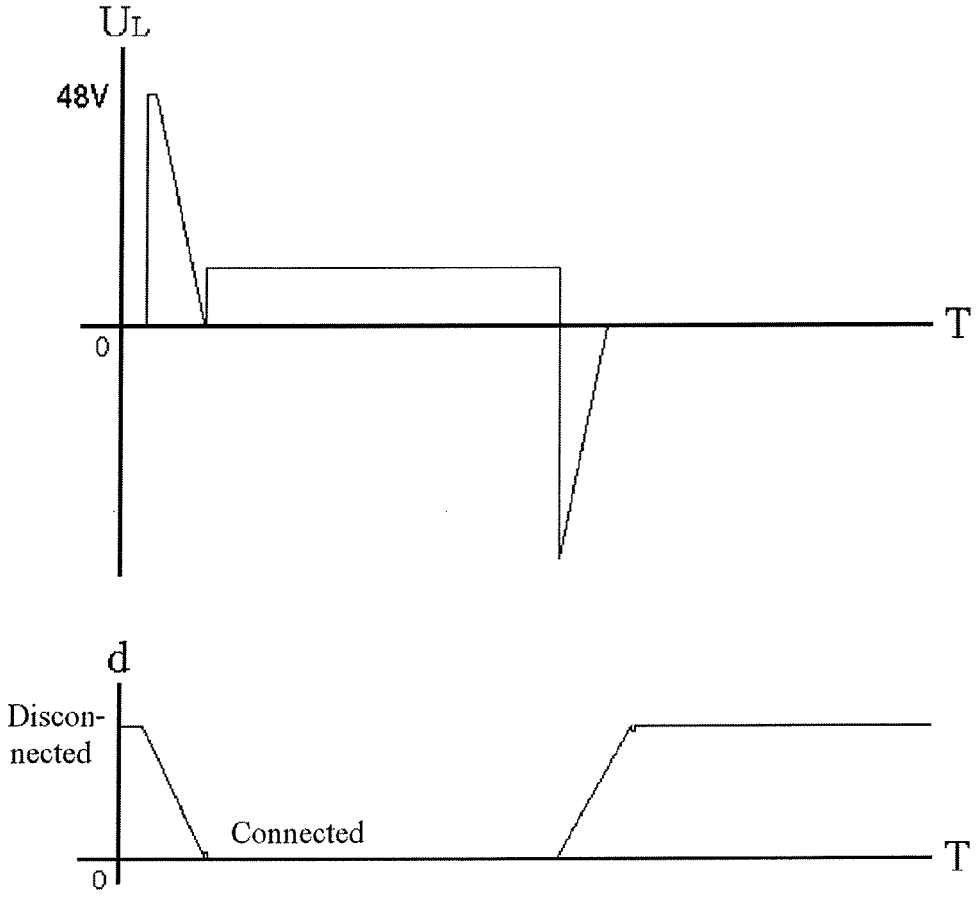
Figure 4:
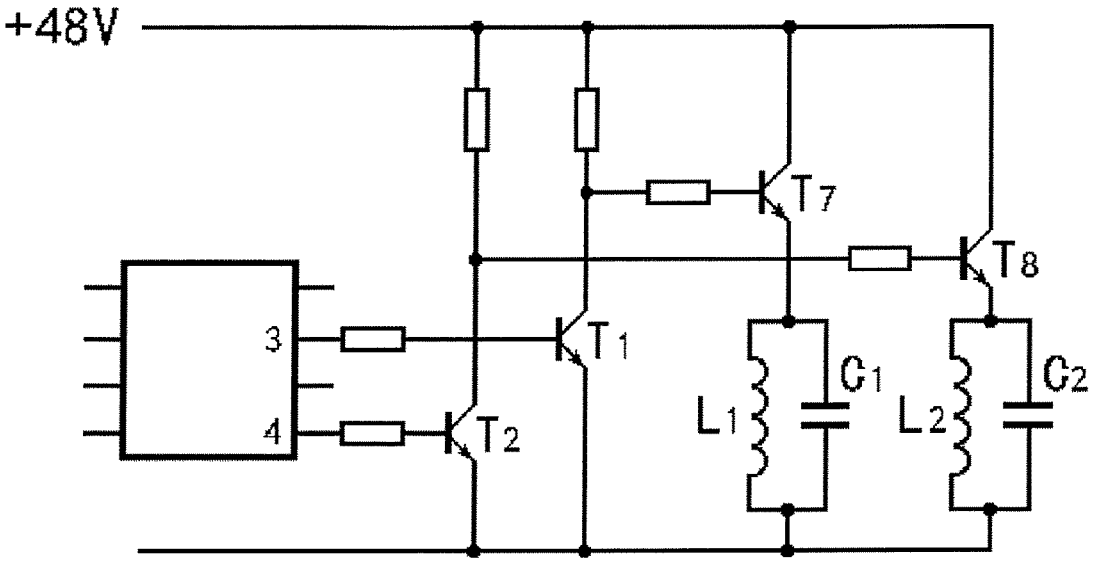
Figures 1, 5:
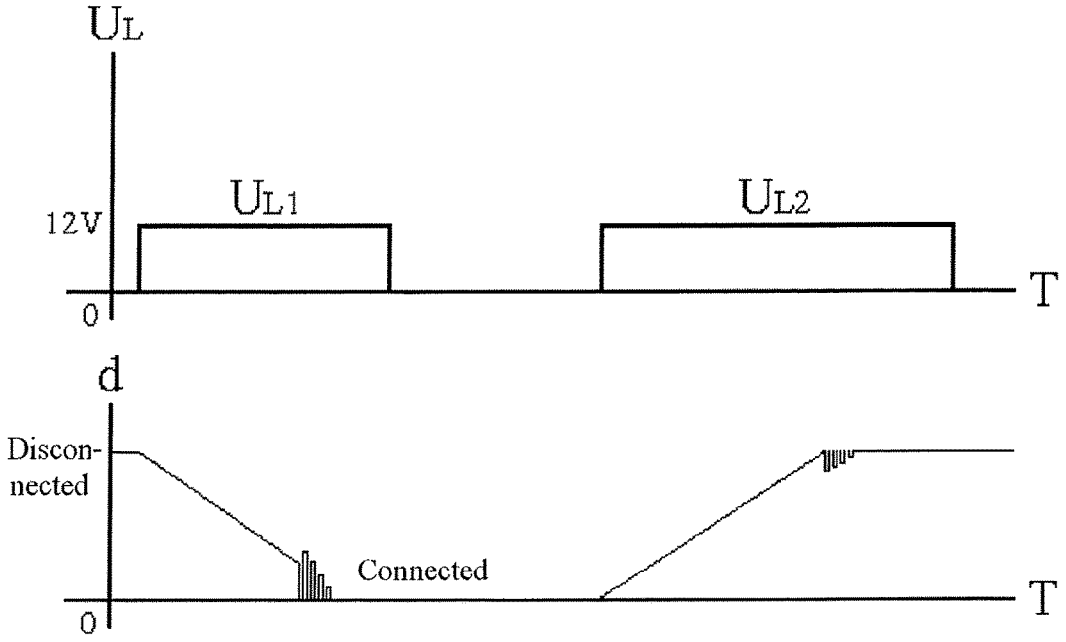
Figures 2, 5:
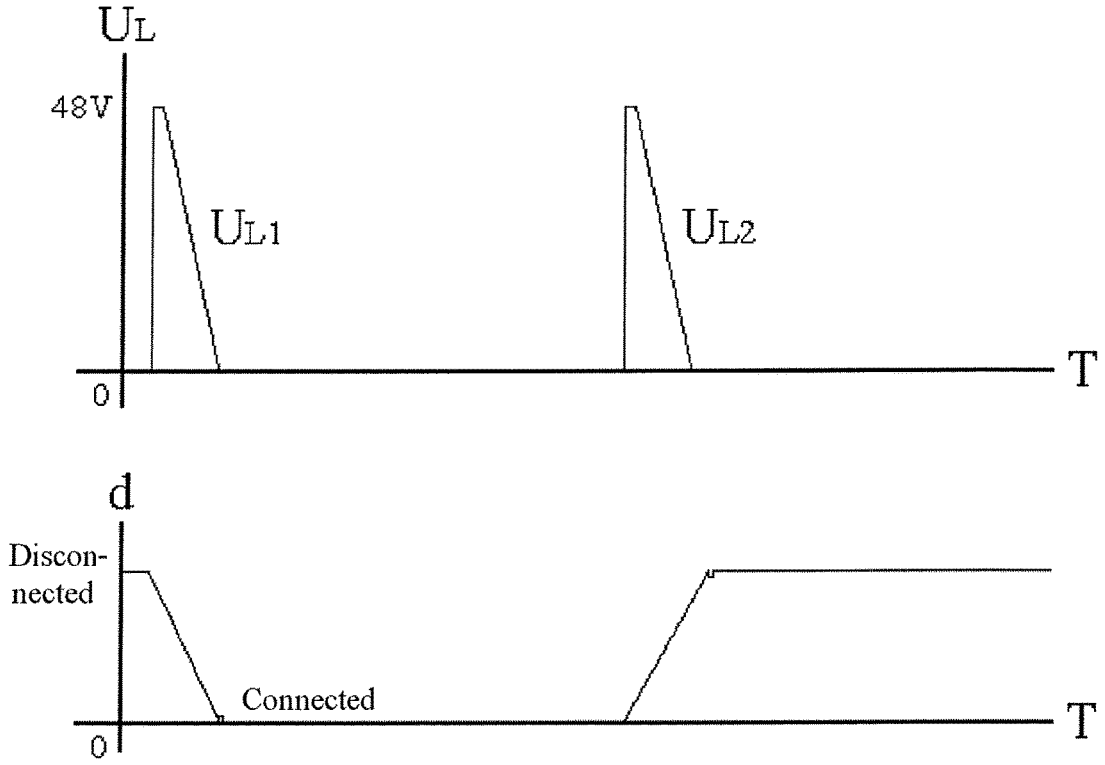
Figure 6:
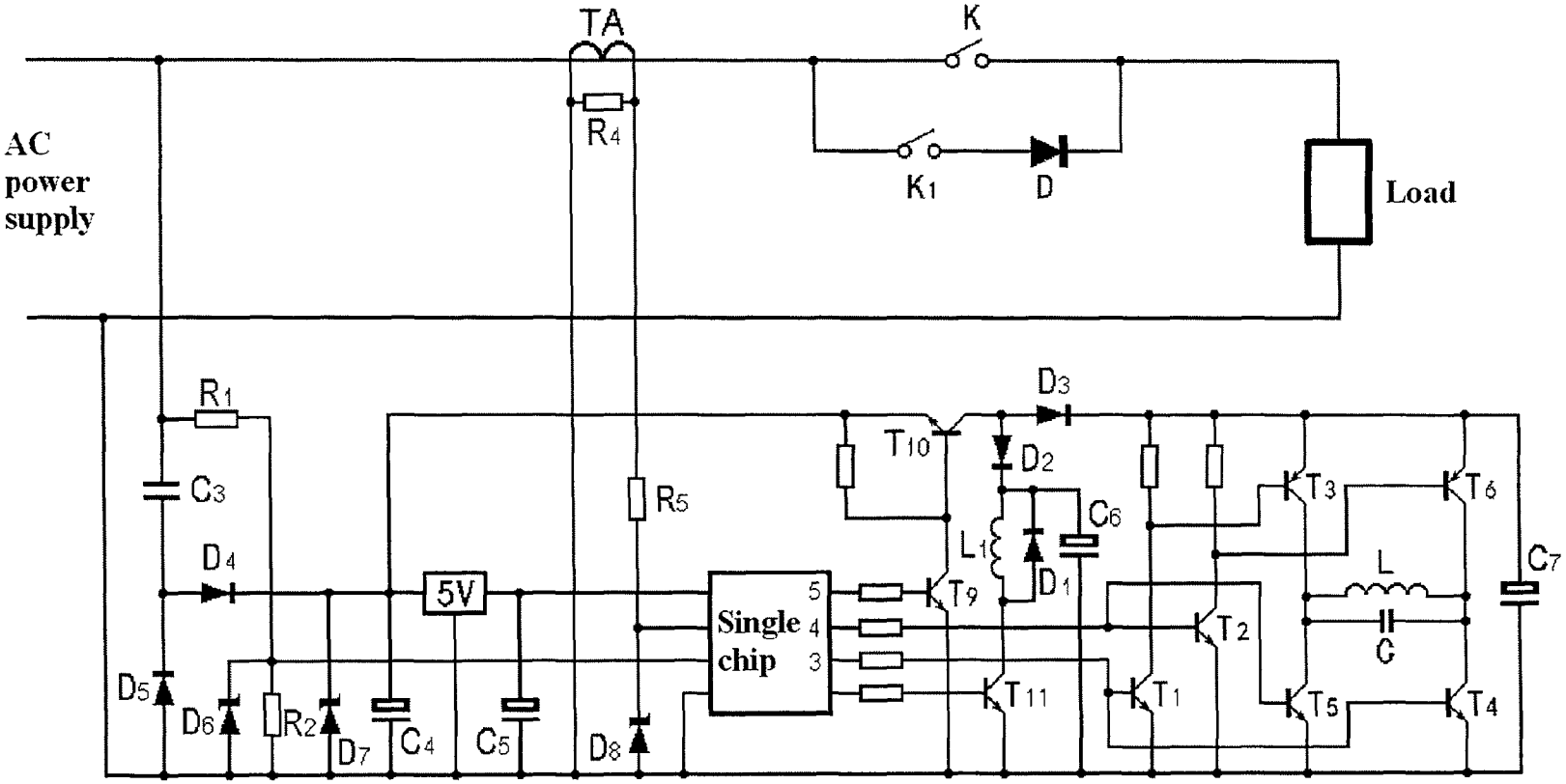

The invention will be further described in detail in combination with the drawings, in which:

FIG. 1 is a schematic circuit diagram of a switch with contact protection based on a diode (i.e. a diode contact protection switch) according to an embodiment of the invention, FIG. 2 is a first schematic circuit diagram of a relay control circuit according to an embodiment of the invention, FIG. 3 shows comparison between a relay actuation travel under the control of the first schematic circuit diagram of the relay control circuit according to the embodiment of the invention and a relay actuation travel under the control of a direct current (DC), FIG. 4 is a second schematic circuit diagram of a relay control circuit according to an embodiment of the invention, FIG. 5 shows comparison between a relay actuation travel under the control of the second schematic circuit diagram of the relay control circuit according to the embodiment of the invention and a relay actuation travel under the control of a direct current (DC), and FIG. 6 is a schematic circuit diagram of a composite switch with contact protection based on a diode according to an embodiment of the invention.

DETAILED DESCRIPTION OF THE EMBODIMENTS

As shown in FIG. 1 which is a schematic diagram of a composite switch with contact protection based on a diode according to an embodiment of the invention, the switch includes a primary relay contact K, a contact protection diode D, an auxiliary relay contact K1 and a relay control circuit. The auxiliary relay contact K1 and the contact protection diode D are connected in series to form a primary relay contact protection circuit, which is connected in parallel at its both ends with the primary relay contact K. Since the auxiliary relay contact K1 bears the entire current at the primary relay contact at the moment when the primary relay contact K is connected or disconnected, an auxiliary relay with a current capacity same as that of the primary relay is typically considered and selected. The higher the contact current capacity of a relay is, the longer the travel time of the relay contact is. In fact, an AC switch relay with a current capacity above 20 A hardly has travel time less than 10 mS. However, the time for a current to flow through the auxiliary relay is very short, and generally is no more than ¼ of one AC cycle. Considering en error of the travel time of the primary relay contact, the travel time of the primary relay contact is no more than 3 mS, and the time for a current to flow through the auxiliary relay contact K1 during each connection/disconnection is generally no more than 3 mS, thus a relay with a low contact current capacity, which is for example 1/10 to 1/1000 of that of the primary relay, is selected as the auxiliary relay to enhance the actuation speed of the contact of the auxiliary relay. The contact travel time of the auxiliary relay may be selected as shorter than ½ of one AC cycle, which may be easily satisfied by a relay with a contact current capacity less than 5 A, that is, if the current capacity of the primary switch relay is 100 A, the auxiliary relay with a current capacity of 1 A-2 A is sufficient. Generally, a switch relay with a low current capacity has a short contact travel time and a low contact withstand voltage. If the contact withstand voltage of a single auxiliary relay cannot meet withstand voltage requirements for the turning off of the switch, a plurality of the auxiliary relays can be connected in serial to improve the contact withstand voltage of a loop of the auxiliary relays. Thus, the use of the relay with a low current capacity as the auxiliary relay can meet the requirements for the contact travel time for the auxiliary relay and reduce costs of the entire switch. A large number of experiments have proved that hundreds of times of the rated current of the relay with a low current capacity can run through the relay within 10 mS without impacting the service life of the relay. Likewise, for a switch with large on-off currents (e.g. from hundreds of amperes to 1,000 A), a plurality of the auxiliary relays can be connected in parallel to comply with the current capacity. When the primary relay of the composite switch with contact protection based on a diode is closed, the primary contact does not bear a voltage, therefore, the contradiction between the contact travel time and the contact current capacity of the relay can be solved by a plurality of relays with a low current capacity connected in parallel. When the composite switch with contact protection based on a diode is closed, the contact of the auxiliary relay (which is protected by a diode) is connected without sparking, and hence the contact of the auxiliary relay further protects the primary contact so that the primary contact is connected without sparking. When the contact of the auxiliary relay is disconnected, the contact of the auxiliary relay protects the primary contact so that the primary contact is disconnected without arcing, and the diode in turn protects the auxiliary contact so that the auxiliary contact is disconnected without arcing. Therefore, the auxiliary contact and the primary contact can be connected in parallel, which provides a new thought for the design of high-voltage large-current switches.

However, in the case of a switch with a current capacity of hundreds of amperes, it is unpractical to connect hundreds of relays with a low current capacity in parallel. In order to shorten the contact travel time of a relay with a high current capacity, a method to reduce the contact travel time of a relay is put forward in the invention. A single-pole single-throw relay has one movable contact and one stationary contact. To close the relay, the movable contact is moved towards the stationary contact against a spring force, and to open the relay, the movable contact is moved apart from the stationary contact by the spring force. Apparently, an increase of the drive current of the relay coil can enhance the force applied to the movable contact so as to accelerate the speed of connecting the contact. However, if the drive current is too large, the contact is severely impacted at the end of its actuation, and the service life of the relay is shortened. The solution provided in the invention lies in that: a large force is applied to the movable contact of the relay at the initial stage of the close action of the relay contact so that the movable contact begins its movement at an improved acceleration, then the force applied to the movable contact is decreased after a period of the accelerated movement so that the movable contact is decelerated, and the velocity of the moveable contact becomes zero when the movable contact arrives at the stationary contact. After the movable and stationary contacts contact with each other, the force applied to the movable contact is increased to be greater than the spring restoring force applied to the movable contact so as to reduce the contact resistance between the contacts. To disconnect the contacts of the relay, a current is applied to the drive coil so that the movable contact is applied with both the spring restoring force and an electromagnetic force from the drive coil, so that the movable contact can depart from the stationary contact at a more rapid speed; when the movable contact nearly arrives at its normally open position, a reverse current is applied to the drive coil to decelerate the movable contact, so that the speed of the movable contact is zero when the movable contact eventually arrives at its normally open position. In this way, by changing the force applied to the contact of the relay during the movement of the contact, the contact travel time of the relay is shortened without influencing the service life of the relay.

FIG. 2 is a first schematic circuit diagram of a relay control circuit for shortening the contact travel time of the relay. A drive coil L for the primary relay is connected with a capacitor C in parallel, and an H-bridge with variable output polarity is formed by four transistors T3, T4, T5 and T6. The drive coil L is connected between an output terminal 1 and an output terminal 2 of the H-bridge, and two output terminals 3 and 4 of a singlechip (e.g. an ordinary 51-typed singlechip) control the width and the polarity of an output voltage pulse from the H-bridge by means of an inverter constituted by transistor T1 and T2. During the actuation of the relay contact, the voltage provided by the relay control circuit to the relay drive coil through the H-bridge is a Pulse-Width Modulation (PWM) pulse signal, which is filtered by the capacitor C to form a continuously changing voltage on the drive coil, so that a continuously changing current flows through the drive coil.

FIG. 3-1 shows time versus a travel of the movable contact of a relay, which has an operating voltage of 12V, when the relay is closed or opened in the case that a DC voltage of 12V is applied to the drive coil for the relay (as shown, UL refers to the voltage applied across the drive coil for the relay, and d refers to a distance between the movable and stationary contacts of the relay during the travel). FIG. 3-2 shows time versus of a travel of the movable contact of the relay, which has an operating voltage of 12V, when the relay is closed or opened in the case that a varying drive voltage is applied by the relay control circuit to the relay. When the output terminals 3 and 4 of the singlechip are at a high level, the four transistors T3, T4, T5 and T6 of the H-bridge are turned off and hence the output from the H-bridge is terminated. However, if the output terminal 3 of the singlechip is at a low level and the output terminal 4 of the singlechip is at the high level, the transistors T3 and T4 of the H-bridge are turned on, and a current flows from an output terminal 1 of the H-bridge to the output terminal 2 of the H-bridge, thus the relay contacts are connected. In closing the relay, the duty ratio of the pulse outputted from the H-bridge is initially large and the current flowing through the drive coil L for the relay is large; then the duty ratio of the pulse is reduced, and a smooth output voltage is obtained from filtering of the pulse by the capacitor C and applied across the drive coil L for the relay, so that the current flowing through the drive coil for the relay becomes lower, here the waveform of the output voltage varies with the duty ratio of the output pulse from the output terminal 3 of the singlechip. When the relay is opened, a reverse voltage pulse outputted by the H-bridge is filtered by the capacitor C and then applied across the drive coil, to shorten the travel time of the disconnection between the contacts of the relay. In comparison with the DC voltage shown in FIG. 3-1, the driving voltage for the relay shown in FIG. 3-2 can enable the quicker connection or disconnection of the contacts of the relay, and also reduce jitters of the contact at the time of closure. Generally, raising the initial value of the driving voltage is most efficient for accelerating the movement of the contact, but increases the power supply cost; besides, when the initial voltage is raised to a certain value, the rising of the initial value becomes less effective in varying the moving speed of the contact of the relay. According to the experimental thought provided by the present invention, those of ordinary skills in the art are able to obtain the shortest travel time and the least jitter at the time of the connection or disconnection of the relay contacts, by changing driving voltages and the PWM output procedure of the singlechip depending on different relays, consequently, the relation between the PWM wave applied across the drive coil and the moving speed of the contact is not described again hereinafter.

Furthermore, the primary relay of the composite switch with contact protection based on a diode described above can be embodied by a magnetic latching relay. In the magnetic latching relay, the drive coil needs not to be electrified any more after the actuation of the relay is completed, which is beneficial for energy saving and cost reduction of driving power. The magnetic latching relay may be driven by a single coil or double coils. The magnetic latching relay driven by a single coil may adopt a circuit shown in FIG. 2, and the specific PWM output therefrom may be designed by those of ordinary skills in the art by experiments, which will not be described again hereinafter. FIG. 4 shows a PWM driving circuit of the magnetic latching relay driven by double coils, and FIG. 5 shows time versus a contact travel when the double coil-driven magnetic latching relay shown in FIG. 4 is closed or opened in the case that the drive coil for the relay is applied with a DC pulse voltage or a PWM driving voltage. FIG. 5-1 shows time versus a travel of the movable contact upon the connection and disconnection of the contacts when a DC voltage of 12V is applied across the drive coil for the magnetic latching relay with an operating voltage of 12V, and FIG. 5-2 shows time versus a travel of the movable contact upon the connection and disconnection of the contacts when a varying voltage with an initial value of 48V is applied across the drive coil for the magnetic latching relay with an operating voltage of 12V (where UL1 represents the voltage of a closing coil, and UL2 represents the voltage of a releasing coil). During the closure of the magnetic latching relay, the PWM voltage is outputted from the transistor T7 to the closing coil L1, and is filtered by a capacitor C1 to generate a decreasing voltage signal with an initial voltage of 48V. The waveform of the signal outputted to the closing coil L1 for the relay depends on the PWM signal outputted from the output terminal 3 of the singlechip. The magnetic latching relay has basically same situation at the time of closure and opening. Therefore, in comparison with the DC voltage shown in FIG. 5-1, the driving voltage waveform shown in FIG. 5-2 can enable the quicker connection or disconnection of the contacts of the relay, and also reduce jitters of the contact at the time of closure.

Furthermore, the relay control circuit for the composite switch with contact protection based on a diode includes a current measuring circuit and a voltage measuring circuit. FIG. 6 is a schematic circuit diagram of the composite switch with contact protection based on a diode according to an embodiment of the invention, in which a buck capacitor C3, two diodes D4 and D5, a voltage regulator diode D7 and a filter capacitor C4 form a 48V capacitance step-down power supply which provides power for a relay drive circuit and a 5V stabilized voltage supply. The power supply for the singlechip is formed by a three-terminal stabilized voltage supply of 5V and a capacitor C5. The capacitance step-down power supply has low power consumption and a small volume, and hence is suitable for supplying power to the AC switch circuit in the invention. A diode D2 and a capacitor C6 form a power supply for the auxiliary relay L1, a diode D3 and a capacitor C7 form a power supply for the primary relay L, and charging of the capacitors C6 and C7 is controlled by transistors T9 and T10. When the output terminal 5 of the singlechip is at a low level, the transistor T10 is turned on and the 48V capacitance step-down power supply charges the capacitors C6 and C7. The drive coil L1 for the auxiliary relay is connected with the capacitor C6 through a transistor T11 to form a loop; when the auxiliary relay is actuated, the transistor T11 is turned on under the control of the relay control circuit, the capacitor C6 discharges to the drive coil L1 for the auxiliary relay through the transistor T11, and the electric current flowing through the drive coil decreases in a logarithmic manner. Such discharging of the capacitor can shorten the travel time of the relay. After the actuation of the relay contact stops, the singlechip turns off the transistor T11 and turns on the transistor T10 to charge the capacitor C6, to prepare for the next actuation of the auxiliary relay. If the primary relay is embodied by a single-coil-driven magnetic latching relay, the capacitor C7 drives the primary relay by a principle basically the same as that of driving the auxiliary relay. A current detecting circuit is formed by a current transformer TA, resistors R4 and R5, and a voltage regulator diode D8. When the current flowing through the switch exceeds the predefined value, the relay is opened under the control of the singlechip to protect the switch and the load. A voltage detecting circuit is constituted by resistors R1 and R2 and the voltage regulator diode, and is configured to on one hand detect a voltage phase to select a time reference for closing or opening the relay, and on the other hand to open the switch to protect the load if an overvoltage or undervoltage condition is detected, which cannot be achieved by the traditional relay switches. Besides, the switch of the present invention may be connected with other sensors (such as a temperature sensor) for more protection functions, and can be controlled remotely with the addition of an infrared sensor or a Bluetooth module.

The relay control method includes the following steps.

Step 1): to close the relay, the relay control circuit provides an initial drive current, which is 2-20 times greater than the rated operational current, to the drive coil for the relay, so that the movable contact of the relay is rapidly moved to the stationary contact, subsequently the drive current is decreased constantly until zero, and the drive current to the drive coil is maintained at the level of a closure holding current of the relay after the movable contact contacts the stationary contact.

Step 2): to open the relay, the relay control circuit provides an initial drive current, which is 2-20 times greater than the rated operational current, to the drive coil for the relay, so that the movable contact of the relay is rapidly moved apart from the stationary contact, subsequently the drive current is decreased constantly, and the drive current becomes zero when the movable contact arrives at its normally open position.

The basic concept of reducing the contact travel time of the relay disclosed in the invention lies in: moving a contact at a rather fast speed at the beginning of a travel of the contact, and subsequently decelerating the contact, so that the movement speed of the contact is substantially reduced to zero when the actuation of the contact stops. In this way, not only the contact travel time is shortened, but jitters and impacts caused when the contact arrives at the end of its travel can be reduced. An implementation for this is that: when the contact of the relay is actuated, the current provided to the drive coil for the relay is a varying current which has a large initial value and decreases subsequently. For different relays, different current curves give rise to different contact travel speed trajectory. Therefore, a new concept is supposed for researches on shortening the travel time of the relay, and a reform of relay designs is introduced. Although some examples of the drive circuit for the drive coil for the relay have been provided herein, other circuits can be obtained from modifying the control circuits for controlling the current flowing through the relay drive coil as described in the invention, but will not be enumerated in an exhausting way.

The composite switch with contact protection based on a diode is closed or opened at a zero-crossing point of current, employs a capacitance step-down power supply, singlechip control, and over-current and overvoltage protection, so that the AC composite switch has a smaller volume, more intellectualized protection functions and a remote control function, thereby obtaining a real intelligent switch, and leading to a revolution of AC power switches.

The present invention is not limited to the optimal embodiments described as above, and other products and methods of various forms may be derived by any individual under the enlightenment of the present invention. Regardless of any changes in shape or structure, the other products and methods with the same or similar technical solutions as the present invention fall within the scope of protection of the present invention.

The invention claimed is:

1. A composite switch with contact protection based on a diode, comprising a primary relay contact protection circuit, a primary relay contact and a relay control circuit, wherein the primary relay contact protection circuit, which is constituted by an auxiliary relay contact (K1) and a diode (D) connected in series, is connected with the primary relay contact (K) in parallel, a current capacity of the auxiliary relay contact (K1) is 1/10 to 1/1000 of that of the primary relay contact (K), wherein the auxiliary relay contact is formed by a plurality of relay contacts connected in series, the primary relay contact is formed by a plurality of relay contacts connected in parallel;

wherein the relay control circuit is powered by a capacitance step-down rectifier power supply, wherein the relay control circuit is formed by a singlechip, an auxiliary relay drive circuit and a primary relay drive circuit, the drive coil (L) for the primary relay is connected in parallel with a capacitor (C) and is connected between output terminals (1) and (2) of an H-bridge constituted by four transistors (T3, T4, T5 and T6);

wherein two output terminals (3) and (4) of the singlechip are configured to control a width and a polarity of an output voltage pulse from the H-bridge by means of an inverter constituted by transistors (T1) and (T2); during an actuation of the primary relay contact, a voltage provide by the relay control circuit to the drive coil (L) for the primary relay is a PWM pulse signal, and a current flowing through the drive coil (L) is changing; and the relay control circuit is configured to supply a changing current to a drive coil when a primary relay is closed.

2. The composite switch with contact protection based on a diode of claim 1, wherein a drive coil (L1) for an auxiliary relay is connected to a capacitor (C6) via a transistor (T11), and when the auxiliary relay contact is actuated, the transistor (T11) is turned on under the control of the singlechip, the capacitor (C6) discharges to the drive coil through the transistor (T11), a current flowing through the drive coil (L1) decreases in a logarithmic manner, and when the actuation of the relay contact stops, the singlechip is configured to turn off the transistor (T11) and turn on a transistor (T10) to charge the capacitor (C6).

3. The composite switch with contact protection based on a diode of claim 1, wherein the relay control circuit comprises a current measuring circuit and a voltage measuring circuit.

4. The composite switch with contact protection based on a diode of claim 2, wherein the auxiliary relay and the primary relay are magnetic latching relays.

5. A relay control method for the composite switch with contact protection based on a diode of claim 1, wherein the relay control method comprises:

Step 1): to close the relay, the relay control circuit provides a changing current, which has an initial value that is 2-20 times greater than a rated operational current, to the drive coil for the relay, so that a movable contact of the relay is rapidly moved to a stationary contact, subsequently the current flowing through the drive coil for the relay is decreased constantly until zero, and the current to the drive coil is maintained at the level of a closure holding current of the relay after the movable contact contacts the stationary contact; and Step 2): to open the relay, the relay control circuit provides a changing current, which has an initial value that is 2-20 times greater than the rated operational current, to the drive coil for the relay, so that the movable contact of the relay is rapidly moved apart from the stationary contact, subsequently the current flowing through the drive coil for the relay is decreased constantly, and the current to the drive coil become zero after the movable contact arrives at its normally open position.

6. The relay control method of claim 5, wherein during the actuation of the relay, the current flowing through the drive coil for the relay is decreased by a logarithmic curve.

* * * * *